US005173579A

United States Patent [19]

Nimberger

[11] Patent Number: 5,173,579

[45] Date of Patent: Dec. 22, 1992

[54] DIFFERENTIAL PRESSURE SWITCH INCLUDING A VERTICAL DIAPHRAGM, A REED SWITCH ACTIVATED BY A FIRST MAGNET AND ADDITIONAL MAGNETS FOR POSITIONING THE DIAPHRAGM AND THE FIRST MAGNET

[75] Inventor: Spencer M. Nimberger, Houston, Tex.

[73] Assignee: Precision General, Inc., Houston, Tex.

[21] Appl. No.: 818,552

[22] Filed: Jan. 9, 1992

[51] Int. Cl.[5] ..... H01H 35/34

[52] U.S. Cl. ..... 200/83 L; 200/82 E; 335/207

[58] Field of Search ..... 200/81.9 M, 82 E, 83 R, 200/83 L, 83 J, 83 S; 340/611, 626; 73/717, 723, 861.97; 307/118; 335/205, 207

[56] References Cited

U.S. PATENT DOCUMENTS

| | | | |
|---|---|---|---|
| 3,285,183 | 11/1966 | Hembree | 200/83 L |
| 3,859,619 | 1/1975 | Ishihara | 200/83 L |
| 3,898,403 | 8/1975 | Grayson | 200/83 Q |
| 3,989,911 | 11/1976 | Perry | 200/83 L |
| 4,084,072 | 4/1978 | Tsubota | 200/83 L |
| 4,266,517 | 5/1981 | Sakakibara et al. | 123/333 |
| 4,739,135 | 4/1988 | Custer | 200/81.9 M |
| 4,827,095 | 5/1989 | Clark et al. | 200/83 J |
| 4,858,647 | 8/1989 | Custer | 137/599.1 |

OTHER PUBLICATIONS

Welker Engineering Co., Differential Flow Switch Style FS-2, Date Unknown but prior, 1 page, United States.

Welker Engineering Co., Differential Flow Switch Style FS-3, 1989, 1 page, United States.

Y-Z Industries, Inc., Electronic Differential Pressure Switch, 1986, 2 pages, United States.

*Primary Examiner*—Gerald P. Tolin

*Attorney, Agent, or Firm*—John R. Kirk, Jr.; Mark A. Oathout

[57] ABSTRACT

The invention comprises a differential pressure switch including a housing which defines a cavity. A diaphragm with a pair of magnets mounted thereon is attached within the housing and vertically disposed across the cavity. This divides the cavity into a high pressure chamber and a low pressure chamber. A high pressure port and ducts in the housing place the medium to be detected in communication with the high pressure chamber. A low pressure port and ducts in the housing place the medium to be detected in communication with the low pressure chamber. The ducts also allow the chambers to drain. A reed switch is attached to the housing proximate the first magnet for maintaining the reed switch in an open state. A third magnet is positioned on the side of the diaphragm opposite the reed switch and in opposition to the second magnet for setting the switch. The third magnet may also be used to adjust the pressure differential required to actuate the reed switch.

16 Claims, 4 Drawing Sheets

DIFFERENTIAL PRESSURE SWITCH INCLUDING A VERTICAL DIAPHRAGM, A REED SWITCH ACTIVATED BY A FIRST MAGNET AND ADDITIONAL MAGNETS FOR POSITIONING THE DIAPHRAGM AND THE FIRST MAGNET

SUMMARY OF THE INVENTION

The present invention generally relates to a differential pressure switch and more specifically relates to a pair of diaphragm mounted magnets which activate a switch when a triggering differential pressure is detected and an external magnet which sets the differential pressure required to activate the switch.

The differential pressure switch includes a housing which defines a cavity. A diaphragm is attached within the housing and vertically disposed across the cavity. This divides the cavity into a high pressure chamber and a low pressure chamber. A high pressure port and ducts in the housing place the medium to be detected in communication with the high pressure chamber. A low pressure port and ducts in the housing place the medium to be detected in communication with the low pressure chamber. The ducts also allow the chambers to drain. A reed switch is attached to the housing proximate the first magnet for maintaining the reed switch in an open state.

The present invention had the ability to measure a pressure differential of 3/10 of an inch of water in a system operating at pressures up to 1,440 psi. The switch has low maintenance requirements since the housing will drain and the internal components are protected. The set point of the switch can optionally be adjusted without opening the housing. Various other advantages will be appreciated by one of ordinary skill in the art.

DETAILED DESCRIPTION OF THE INVENTION

Figure 1:
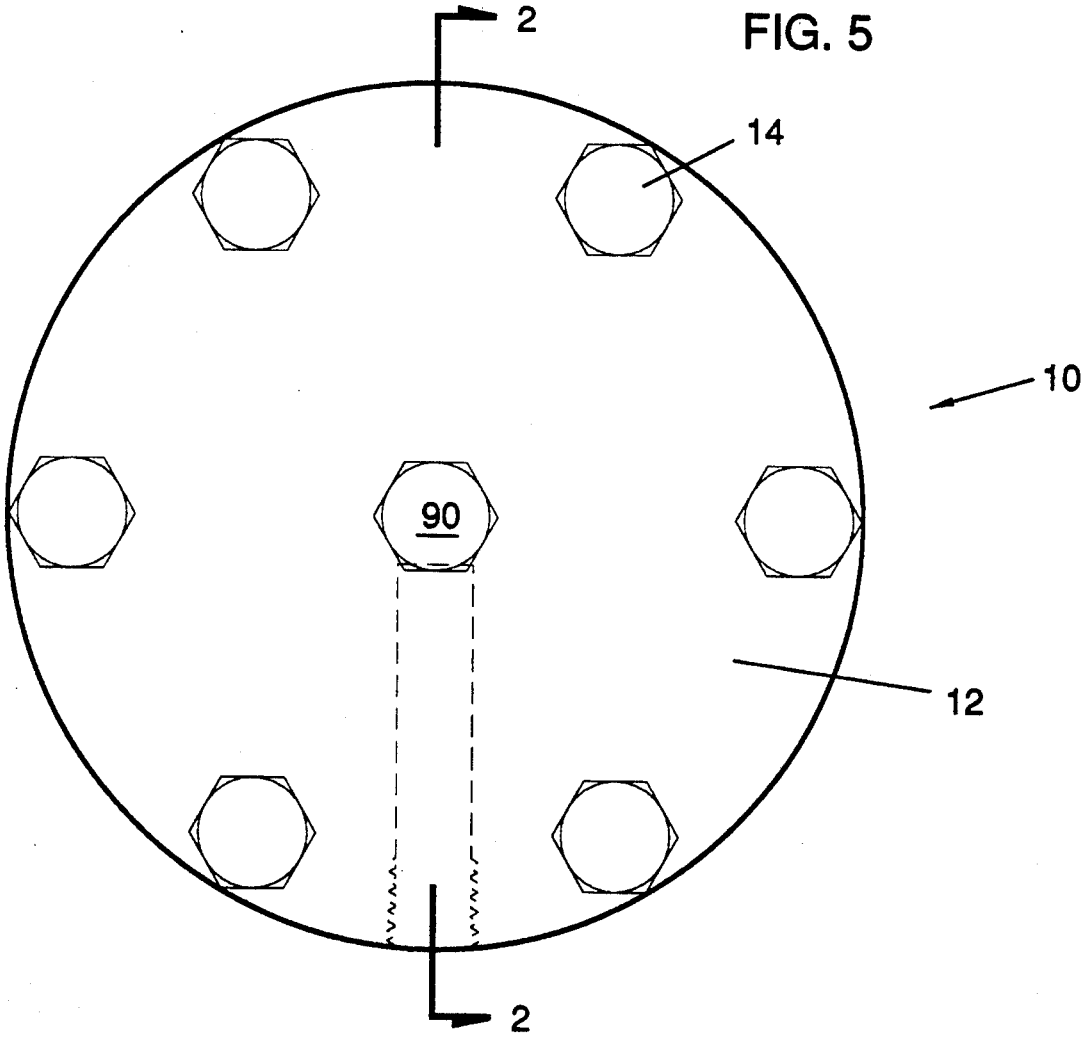
FIG. 1 is an external elevational view of the differential pressure switch.
Figure 2:
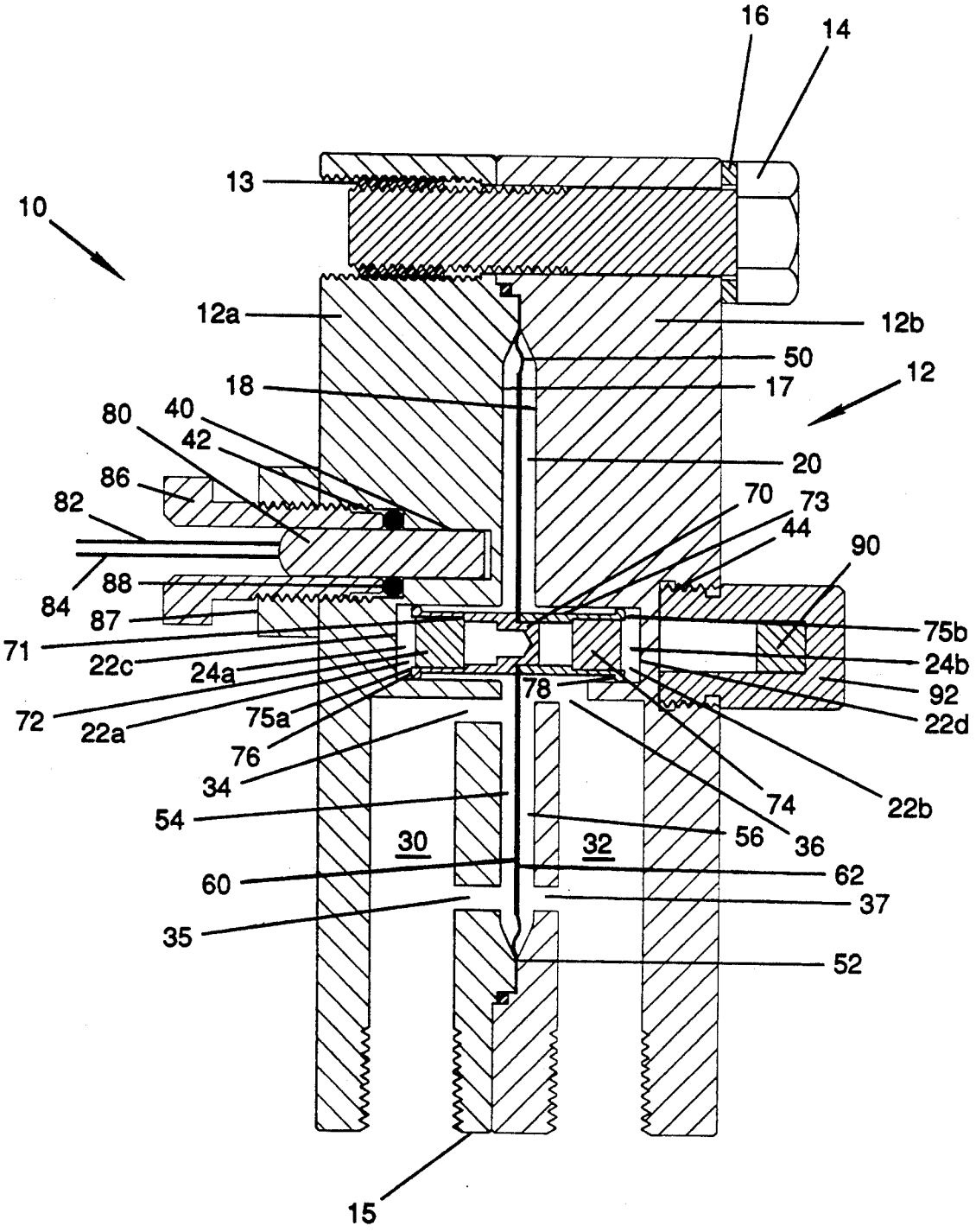
FIG. 2 is an elevational cross-sectional view of the differential pressure switch taken along line 2—2 of FIG. 1.

Referring to FIGS. 1 and 2 the differential pressure switch 10 generally includes a housing 12, a diaphragm 50, a bridge 70 containing a first and second magnet 72 and 74, a reed switch 80 and a third magnet 90.

Housing 12 is preferably made from a first housing portion 12*a* which is attached to a second housing piece 12*b* with helicoil 13, bolts 14 and washers 16. Both the first housing portion 12*a* and the second housing portion 12*b* have recessed surfaces 17 and 18, respectively. When the housing 12 is assembled the recessed surfaces define a cavity 20 which is preferably annular. First and second housing portions 12*a* and 12*b* also define bores 22*a* and 22*b*, respectively, extending from the recessed surfaces 17 and 18, respectively, to allow motion of bridge 70.

First housing portion 12*a* defines a high pressure port 30 which enters the first housing portion 12*a* at a flow line connection end 15. Second housing portion 12*b* defines a low pressure port 32 which enters the second housing portion 12*b* at the flow line connection end 15. The first housing portion 12*a* defines a series of ducts 34 and 35 which places one side of the cavity 20 in communication with the high pressure port 30. The second housing portion 12*b* defines a series of ducts 36 and 37 which places the other side of the cavity 20 in communication with the low pressure port 32. The number and size of ducts 34, 35, 36 and 37 may be increased or decreased (and the shape and configuration may be changed) as needed to achieve uniformity in the sensing of pressure differentials.

Housing 12 may be modified for mounting to the flow line or structure containing the medium to be detected. First housing portion 12*a* preferably defines a switch passage 40 which as shown is a recessed bore from a switch retaining bore 42. Both bores 40 and 42 are isolated from cavity 20. Second housing portion 12*b* preferably defines a switch setting passage 44.

Figure 3:
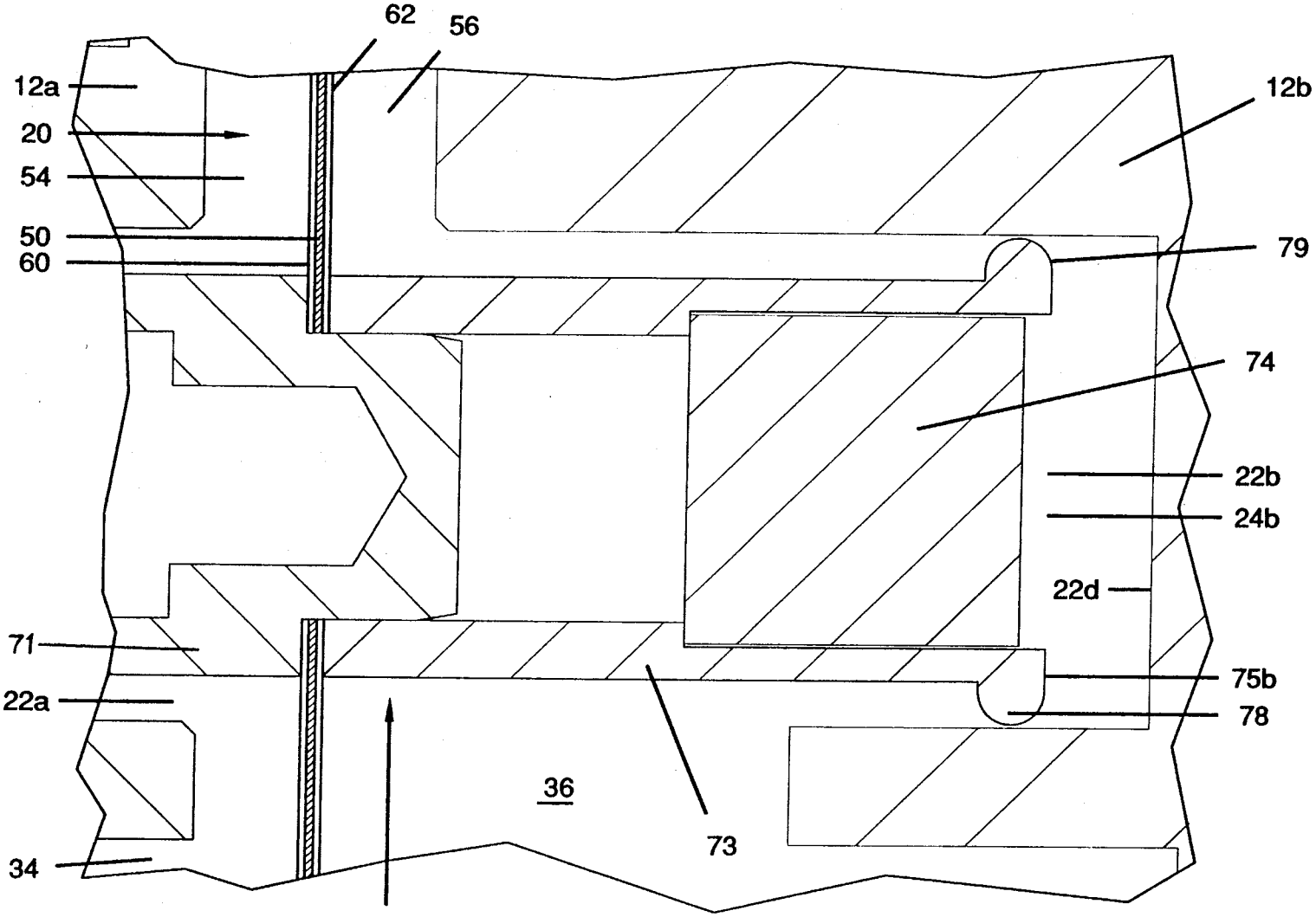
FIG. 3 is an enlarged view taken from FIG. 2 showing portions of the diaphragm, bridge and chambers.

Referring to FIGS. 2 and 3 a diaphragm 50 is vertically disposed within cavity 20 and is attached at its periphery 52 to the housing 12. The diaphragm 50 is elastic and may be made of a material such as "VITON". Attachment is preferably accomplished by clamping the periphery 52 of the diaphragm 50 between the first housing portion 12*a* and the second housing portion 12*b*. Diaphragm 50 is preferably circular. The diaphragm 50 divides the cavity 20 into a high pressure chamber 54 and a low pressure chamber 56. The diaphragm 50 has a hole at the center. A first stability plate 60 is preferably attached to one side of diaphragm 50 and a second stability plate 62 is preferably attached to the other side of diaphragm 50. First stability plate 60 and a second stability plate 62 have a hole at the center corresponding to the central hole of diaphragm 50 and an outer diameter which covers ducts 34, 35, 36 and 37. Stability plates 60 and 62 are preferably thin (0.005 inches) and made from a non-magnetic material such as stainless steel. The plates 60 and 62 may be adhered to diaphragm 50. However the plates 60 and 62 may also be clamped to diaphragm 50 by bridge 70.

Figure 6:
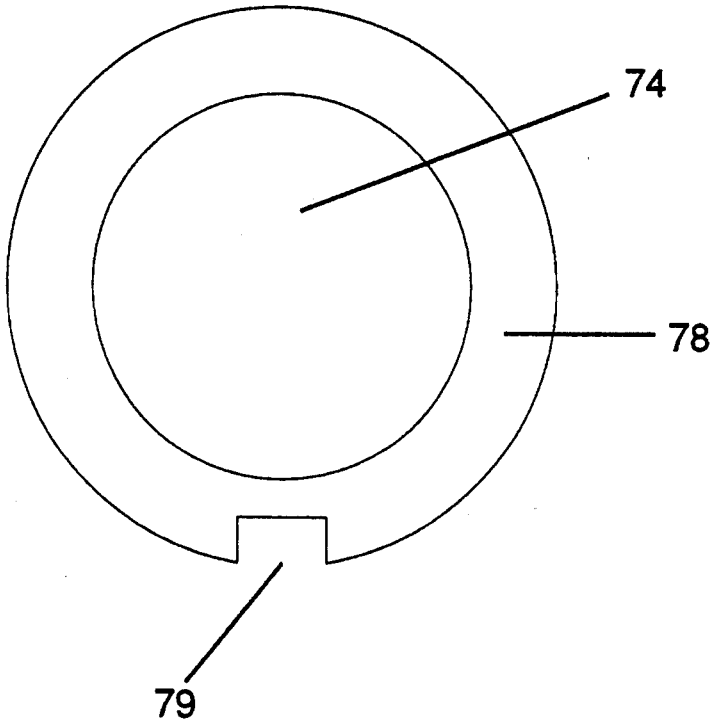
FIG. 6 is an end view of the bridge and the second magnet.

Bridge 70 includes a male member 71 and a female member 73. Both the male member 71 and the female member 73 include a recessed bore. First magnet 72 is fixed in the recessed bore of male member 71. Second magnet 74 is fixed in the recessed bore of female member 73. The poles of first magnet 72 and second magnet 74 are preferably aligned to be coaxial with the axis through the center of diaphragm 50. Male member 71 is attached to female member 73 with stability plates 60 and 62 and diaphragm 50 interposed therebetween. A rim 76 is preferably located at the distal end of male member 71. Another rim 78 is located at the distal end of female member 73. Both rims 76 and 78 preferably include slots (slot in rim 76 not shown but similar to 79) and 79 (FIG. 6). Rims 76 and 78 minimize the area of contact between bridge 70 and housing 12 to decrease the drag on bridge 70. A small clearance (preferably 0.005 inches) between rims 76 and 78 and housing 12 functions to prevent tilting of bridge 70, sagging of diaphragm 50 and offsetting of the magnetic fields produced by the first magnet 72 and the second magnet 74. When bridge 70 is centered gaps 24*a* and 24*b* are formed between the ends 75*a* and 75*b* of bridge 70 and the ends 22*c* and 22*d* of bores 22*a* and 22*b*, respectively. In this position the width ("width" is defined as the horizontal distance between surfaces shown in FIGS. 2 and/or 3) of each gap 24*a* and 24*b* is equal to the width of each chamber 54 and 56.

A reed switch 80 is disposed in the switch passage 40. Potting compound (not shown) as known in the art may also be placed over the switch wires 82, 84. The reed switch 80 and potting compound can be retained with a switch retaining nut 86, jam nut 87 and seal 88. The reed switch 80 is of a design known in the art which includes two parallel strips which are normally closed or touching. When properly oriented in the flux of a magnetic field the strips will move thereby opening the switch. When the magnetic field is removed or the orientation of the lines of flux are properly changed the reed switch will then close. The longer axis of reed switch 80 is preferably positioned parallel to but not co-axial with the pole of first magnet 72 and within close proximity of the first magnet 72 such that the reed switch 80 will be open when diaphragm 50 is normally biased toward the reed switch 80 by a repulsion force between the second and third magnets 74 and 90. The reed switch passage 40 is not in communication with either of the ports 30, 32, ducts 34, 35, 36, 37 nor the cavity 26. As such the reed switch 80 is insulated from the medium to be detected to protect the reed switch 80 from corrosion.

The third magnet 90 is preferably externally attached to the second housing portion 12*b* with an external screw 92. The external screw 92 is preferably threaded into the switch setting passage 44. The third or external magnet is fixed within a bore of external screw 92. The third magnet 90 may be fixed anywhere within the bore as desired. The pole of the third magnet 90 is preferably coaxial with the central axis through diaphragm 50 and opposes the pole of the second magnet 74.

Figure 4:
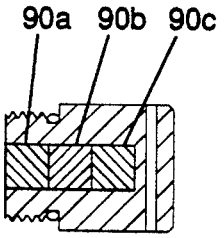
FIG. 4 is a cross-sectional view of another embodiment of the external or third magnet.

Referring to FIG. 4 external screw 92 is shown with three magnets 90*a*, 90*b* and 90*c* fixed therein. Other arrangements are possible to achieve a desired external magnetic flux.

Figure 5:
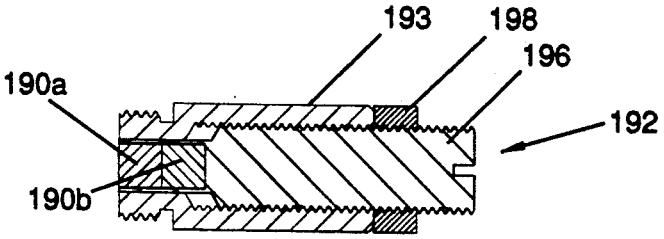
FIG. 5 is a cross-sectional view of another embodiment of the external or third magnet.

Referring to FIG. 5 another embodiment which may replace external screw 92 is shown. External screw 192 includes an outer screw 193 which is threaded into the switch setting passage 44. An inner screw 196 is moveable with respect to the outer screw 193. A lock nut 198 may also be used in this embodiment. Magnet 190*a* is fixed to magnet 190*b* (more or less magnets may be used) which is fixed to the end of internal screw 196. By threading internal screw 196 the magnetic field can be moved with respect to the outer screw 193 and therefore with respect to bridge 70 and second magnet 74. External screw 192 therefore allows ready adjustment of the differential pressure required to "trip" the differential pressure switch 10.

The orientation of the magnets 90, 90*a*, 90*b*, 90*c* or 190*a* and 190*b* can be changed. What is important is that they be positioned such that when there is no pressure differential the reed switch will be oriented to be opened by the magnetic flux of the first magnet and which is done by orienting them such that the magnetic fluxes or fields of the second and third magnets are opposing or repelling. The first and second magnets 72 and 74 may be oriented to attract or to repel each other.

The differential pressure switch 10 can be used to detect different pressures depending on the level of the liquid within a vessel (not shown) however it is normally used to detect the flow of a medium. When the differential pressure switch is used to detect the flow of a medium it is normally used with an orifice plate (not shown) as is known in the art. The high pressure port 30 will be located on the upstream end of the orifice plate and the low pressure port 32 will be located downstream. When there is no flow the pressure differential will be zero. In this state the repulsive forces between second magnet 74 and third magnet 90 will normally cause diaphragm 50 to expand or "bulge out" slightly towards reed switch 80 (This "bulging out" is limited since the end 75*a* of bridge 70 will eventually contact the end 22*c* of bore 22*a* and plate 60 will contact recessed surface 17; this contact also prevents rim 78 from dropping into duct 36).

During no flow conditions, the switch 10 will remain in an open state. When the medium begins to flow a pressure differential can be detected between high pressure port 30 and low pressure port 32 as is known to one skilled in the art. The flow will first be detected at the upstream or high pressure port 30 and ducts 34 and 35 allow access of the medium into the high pressure chamber 54. The flow will also be detected at the downstream or low pressure port 32 which communicates the medium through ducts 36 and 37 to the low pressure chamber 56.

The differential pressure switch 10 can be set to activate only when a certain threshold pressure differential is reached. This is because the repulsive force between the second and third magnets can be used to prevent detection of differentials below the threshold level. With the magnets the threshold level can be up to five inches of water.

The pressure differential will cause the diaphragm 50 to expand or "bulge out" against the frictional forces between bridge 70 and housing 12 and against the force of the third magnet 90 towards the external screw 92. If the pressure differential is great enough the magnetic field or flux lines from first magnet 72 will be moved such that the reed switch 80 will be closed or activated to send a signal, for example, to a control panel that flow has been detected. The "bulging out" is limited at the center of the diaphragm 50 by contact between the end 75*b* of bridge 70 and the end 22*d* of bore 22*b*. The "bulging out" is also limited by plate 62 striking recessed surface 18. As the pressure equalizes the third magnet 90 will repel the second magnet 74 to place the first magnet 72 in position to open reed switch 80. While the rims 76 and 78 help to support and stabilize the diaphragm 50, the slots 77 and 79, respectively, allow the medium in gaps 24*a* and 24*b* to vent or drain.

To prevent corrosion and to produce more accurate detection of pressure differentials the medium is drained from chamber 20 primarily through ducts 35 and 37. The differential pressure switch 10 is also designed fro severe overpressure conditions. For example, if only one of the ports 30 or 32 was connected it would be possible to experience a 1,000 psi pressure on one side of the diaphragm and zero on the other side. The diaphragm 50 is made of a sturdy material to prevent damage to the diaphragm. However, the diaphragm must also be delicate to produce accurate readings. Thus, stability plates 60 and 62 may also be used to protect diaphragm 50 during a severe overpressure conditon. Severe overpressure conditions can occur, for instance, when only one of the ports 30 or 32 is connected or open. Stability plates 60 and 62 prevent diaphragm 50 from being blown into the ducts or from tearing on edges around the ducts and must cover all ducts.

Another feature of the invention is the ability to control the amount of pressure differential required to activate the reed switch 80. This amount can be adjusted through manipulation of the third magnet 190 (FIG. 5) via the adjusting screw 192. Since the magnetic fields between the second and third magnets are opposing a positioning of the third magnet 90 (or 190, FIG. 5) closer to the second magnet 74 will require a greater pressure differential to actuate or "trip" the switch relative to an adjustment to move the third magnet 90 (or 190) away from the second magnet 74 which will require a lesser pressure differential to actuate the reed switch 80 (all else being equal).

The housing 12, bolts 14 and bridge 70 are preferably made from a non-magnetic material such as aluminum or stainless steel. The magnets 72, 74 and 90 may be rare earth or ceramic magnets. Compactness is important to the design of differential pressure switch 10. For instance, the entire travel space for bridge 70 is approximately 0.120 inches.

The preferred embodiment of the invention has been shown and described above. It is to be understood that minor changes in the details, construction and arrangement of the parts and steps may be made without departing from the spirit or scope of the invention as described and claimed. For example, the normally closed reed switch 80 could be replaced by a normally open reed switch with the system designed to monitor a switch sequence which is the opposite of the sequence described above.

What is claimed is:

1. A differential pressure switch mounted to a source of a medium, comprising:

a housing defining a cavity;

a diaphragm vertically disposed across the cavity and secured to said housing to divide the cavity into a high pressure chamber and a low pressure chamber;

said housing further defining a means for admitting fluid pressures into the chambers for moving said diaphragm in response to differential pressure between the chambers;

a first magnet attached to said diaphragm in the high pressure chamber;

a second magnet attached to said diaphragm in the low pressure chamber;

a third magnet disposed in said housing having a field oriented to oppose a field of said second magnet for positioning said diaphragm and said first magnet within the cavity; and a reed switch disposed in said housing within a field of said first magnet for maintaining said reed switch in non-detecting state, said reed switch being transformable to a detecting state by movement of said first magnet when said diaphragm is moved in response to an actuating differential pressure between the chambers.

2. The differential pressure switch according to claim 1 wherein said high pressure chamber and said low pressure chamber include a means for draining the medium from said chambers.

3. The differential pressure switch according to claim 2 wherein said draining means comprises a series of ducts defined by said housing running between a lower end of the chambers and the means for admitting fluid pressures into the chambers.

4. The differential pressure switch according to claim 1 wherein said housing defines a switch passage for the disposing of said reed switch, the switch passage being separate from said chambers and parallel to an axis through said first magnet.

5. The differential pressure switch according to claim 4 wherein said reed switch disposed in the switch passage is not coaxial with the axis through said first magnet.

6. The differential pressure switch according to claim 3 further including a means for preventing a blowout of said diaphragm.

7. The differential pressure switch according to claim 6 wherein said means for preventing a blowout of said diaphragm comprises:

a first plate attached to one side of said diaphragm; and a second plate attached to the other side of said diaphragm, said first plate and said second plate having an outer diameter which overlaps the ducts.

8. The differential pressure switch according to claim 7 wherein said means for preventing a blowout of said diaphragm further includes:

a bridge connected to said diaphragm, said bridge having one end projecting into the high pressure chamber and another end projecting into the low pressure chamber to define two gaps, respectively, between the ends of said bridge and said housing, each gap having a width equal to the width of each of the chambers, said bridge including a means for supporting said first magnet and said second magnet.

9. The differential pressure switch according to claim 8 wherein said bridge includes a means for stabilizing said diaphragm, said stabilizing means defining a means for draining medium located beyond an end of said bridge.

10. The differential pressure switch according to claim 1 further including a means for adjusting the field of said third magnet.

11. A differential pressure switch mounted to a source of a medium comprising:

a housing defining a cavity;

a diaphragm vertically disposed across the cavity and secured to said housing to divide the cavity into a high pressure chamber and a low pressure chamber;

said housing further defining a means for admitting fluid pressures into the chambers for moving said diaphragm in response to differential pressure between the chambers;

said housing further defining a series of ducts running between a lower end of the chambers and the means for admitting fluid pressures into the chambers;

a first plate attached to one side of said diaphragm;

a second plate attached to the other side of said diaphragm;

said first plate and said second plate having an outer diameter which overlaps the ducts;

a bridge connected to said diaphragm, said bridge having one end projecting into the high pressure chamber and another end projecting into the low pressure chamber to define two gaps, respectively, between the ends of said bridge and said housing, each gap having a width equal to the width of each of the chambers;

said bridge having a rim circumscribing each end of said bridge, each of said rims defining a slot;

a first magnet attached to said bridge in the high pressure chamber;

a second magnet attached to said bridge in the low pressure chamber;

a third magnet disposed in said housing having a field oriented to oppose the field of said second magnet for positioning said diaphragm and said first magnet within the cavity; and a reed switch disposed in said housing within a field of said first magnet for maintaining said reed switch in a non-detecting state, said reed switch being transformable to a detecting state by movement of said first magnet when said diaphragm is moved in response to an actuating differential pressure between the chambers.

12. A differential pressure switch according to claim 11 further including a means for adjusting the field of said third magnet.

13. The differential pressure switch according to claim 12 wherein said means for adjusting the field of said third magnet comprises a screw having a means to hold said third magnet and being threadable into a threaded passage defined by said housing, said third magnet having a pole coaxial with a pole of said second magnet.

14. The differential pressure switch according to claim 11 wherein said housing defines a switch passage for the disposing of said reed switch, the switch passage being separate from said chambers and parallel to an axis through said first magnet.

15. The differential pressure switch according to claim 14 wherein said reed switch disposed in the switch passage is not coaxial with the axis through said first magnet.

16. The differential pressure switch according to claim 11 wherein said housing is made of a non-magnetic material.

* * * * *